US012173915B2

(12) United States Patent
Li et al.

(10) Patent No.: US 12,173,915 B2
(45) Date of Patent: Dec. 24, 2024

(54) AIR CONDITIONER DEFROSTING CONTROL METHOD AND DEVICE, AND NON-TRANSITORY STORAGE MEDIUM AND AIR CONDITIONER

(71) Applicant: Gree Electric Appliances, Inc. of Zhuhai, Guangdong (CN)

(72) Inventors: Zhiqiang Li, Guangdong (CN); Dandan Lyu, Guangdong (CN); Jiancheng Li, Guangdong (CN); Yulong Liang, Guangdong (CN); Weishuang Liu, Guangdong (CN); Qiuyu Zhang, Guangdong (CN); Ping Wang, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 238 days.

(21) Appl. No.: 17/911,251

(22) PCT Filed: Mar. 17, 2021

(86) PCT No.: PCT/CN2021/081223

§ 371 (c)(1),
(2) Date: Sep. 13, 2022

(87) PCT Pub. No.: WO2021/208660

PCT Pub. Date: Oct. 21, 2021

(65) Prior Publication Data

US 2023/0250983 A1 Aug. 10, 2023

(30) Foreign Application Priority Data

Apr. 13, 2020 (CN) ..... 202010284893.2

(51) Int. Cl.
*F24F 11/42* (2018.01)
*F25B 47/02* (2006.01)

(52) U.S. Cl.
CPC ..... *F24F 11/42* (2018.01); *F25B 47/02* (2013.01); *F25B 2313/0315* (2013.01);
(Continued)

(58) Field of Classification Search
CPC ..... F25B 47/022; F25B 2313/0315; F25B 2600/2513; F25B 2700/11; F25B 2700/2103; F25B 2700/21152; F24F 11/42
See application file for complete search history.

(56) References Cited

U.S. PATENT DOCUMENTS 5,628,201 A 5/1997 Bahel et al.
2015/0267957 A1* 9/2015 Kim ..... F25B 49/02 62/81

(Continued)

FOREIGN PATENT DOCUMENTS

CN 105987551 A 10/2016
CN 106989488 A 7/2017

(Continued)

*Primary Examiner* — Marc E Norman
(74) *Attorney, Agent, or Firm* — The Webb Law Firm

(57) ABSTRACT

The present disclosure provides an air conditioner defrosting control method and device, and a storage medium and an air conditioner. The control method includes: setting a target discharge temperature of a compressor and an initial opening degree of a throttle device when an air conditioner performs defrosting according to an outdoor ambient temperature when the air conditioner meets a defrosting condition and enters a defrosting mode; controlling a defrosting operation of the air conditioner according to the target discharge temperature of the compressor and the initial opening degree of the throttle device; and controlling the air conditioner to exit the defrosting mode when a temperature of an outdoor heart exchanger of the air conditioner reaches a set temperature value.

15 Claims, 7 Drawing Sheets

(52) U.S. Cl.
CPC ..... *F25B 2600/2513* (2013.01); *F25B 2700/11* (2013.01); *F25B 2700/2103* (2013.01); *F25B 2700/21152* (2013.01)

(56) References Cited

U.S. PATENT DOCUMENTS

| | | | | |
|---|---|---|---|---|
| 2018/0209677 | A1* | 7/2018 | Yang | F25B 47/02 |
| 2019/0032978 | A1* | 1/2019 | Ohura | F25B 47/02 |
| 2019/0063793 | A1 | 2/2019 | Tang | |
| 2019/0242604 | A1 | 8/2019 | Wan et al. | |
| 2021/0080140 | A1* | 3/2021 | Lee | F25B 13/00 |

FOREIGN PATENT DOCUMENTS

| | | | |
|---|---|---|---|
| CN | 107044716 | A | 8/2017 |
| CN | 104913452 | B | 11/2017 |
| CN | 109028464 | A | 12/2018 |
| CN | 109323371 | A | 2/2019 |
| CN | 109631236 | A | 4/2019 |
| CN | 109990517 | A | 7/2019 |
| CN | 110986334 | A | 4/2020 |
| CN | 111425992 | A | 7/2020 |
| EP | 2592367 | A2 | 5/2013 |
| JP | H9257345 | A | 10/1997 |
| WO | 2014106030 | A1 | 7/2014 |
| WO | 2017130845 | A1 | 8/2017 |

* cited by examiner

AIR CONDITIONER DEFROSTING CONTROL METHOD AND DEVICE, AND NON-TRANSITORY STORAGE MEDIUM AND AIR CONDITIONER

CROSS-REFERENCE TO RELATED APPLICATIONS

This application is the United States national phase of International Application No. PCT/CN2021/081223, filed on Mar. 17, 2021, and claims priority to Chinese Patent Application No. 202010284893.2 filed on Apr. 13, 2020, the disclosures of which are hereby incorporated by reference in their entirety.

BACKGROUND OF THE DISCLOSURE

Field of the Disclosure

The present disclosure relates to an air conditioner defrosting control method and device, a storage medium and an air conditioner.

Description of Related Art

When an air conditioner is in heating operation, with the decrease of an ambient temperature, a pressure on a low pressure side of the system decreases, as a result an evaporating temperature of a refrigerant decreases, and the heat that the outdoor unit heat exchanger of the air conditioner can absorb from the environment decreases accordingly. When the temperature of the finned heat exchanger is lower than 0° C., the water vapor in the air will precipitate on the surface of the finned heat exchanger in the form of frost when it encounters the finned heat exchanger. Frosting on the fins will increase the heat exchange resistance, reduce the air circulation area, and eventually lead to a decrease in the heating capacity of the air conditioning unit.

SUMMARY OF THE DISCLOSURE

One aspect of the present disclosure provides an air conditioner defrosting control method, comprising: setting a target discharge temperature of a compressor and an initial opening degree of a throttle device when an air conditioner performs defrosting according to an outdoor ambient temperature when the air conditioner meets a defrosting condition and enters a defrosting mode; controlling a defrosting operation of the air conditioner according to the target discharge temperature of the compressor and the initial opening degree of the throttle device; and controlling the air conditioner to exit the defrosting mode when a temperature of an outdoor heat exchanger of the air conditioner reaches a set temperature value.

Another aspect of the present disclosure provides an air conditioner defrosting control device, comprising: a setting unit configured to set a target discharge temperature of a compressor and an initial opening degree of a throttle device when an air conditioner performs defrosting according to an outdoor ambient temperature when the air conditioner meets a defrosting condition and enters a defrosting mode; and a control unit configured to control a defrosting operation of the air conditioner according to the target discharge temperature of the compressor and the initial opening degree of the throttle device, and control the air conditioner to exit the defrosting mode when a temperature of an outdoor heat exchanger of the air conditioner reaches a set temperature value.

Yet another aspect of the present disclosure provides a non-transitory storage medium on which a computer program is stored, which when executed by a processor implements any one of the aforementioned methods.

Yet another aspect of the present disclosure provides an air conditioner, comprising a processor, a memory, and a computer program stored on the memory and executable on the processor, wherein the processor when executing the program implements any one of the aforementioned methods.

Yet another aspect of the present disclosure provides an air conditioner, comprising any of the air conditioner defrosting control devices described above.

BRIEF DESCRIPTION OF THE DRAWINGS

The accompanying drawings described herein are used to provide a further understanding of the present disclosure and constitute a part of the present disclosure. The exemplary embodiments of the present disclosure and their descriptions are used to explain the present disclosure, but do not constitute an improper limitation of the present disclosure. In the drawings.

DETAILED DESCRIPTION

In order to make the objectives, technical solutions, and advantages of the present disclosure clearer, the technical solutions of the present disclosure will be described clearly and completely in combination with specific embodiments of the present disclosure and corresponding drawings. Obviously, embodiments described are only a part of the embodiments of the present disclosure, and not all of embodiments thereof. All other embodiments obtained by those of ordinary skill in the art based on the embodiments of the present disclosure without creative efforts shall fall within the protection scope of the present disclosure.

It should be noted that the terms "first", "second" and the like in the description and claims of the present disclosure and the drawings are used to distinguish similar objects, and are not necessarily used to describe a specific order or sequence. It should be understood that the terms so used may be interchanged where appropriate so that the embodiments of the disclosure described herein can be implemented in an order other than those illustrated or described herein. Furthermore, the terms "comprising" and "having" and any of their variations are intended to cover non-exclusive inclusions, for example, a process, method, system, product, or device that comprises a series of steps or units need not be limited to those explicitly listed, instead it can comprise other steps or units not explicitly listed or inherent to this process, method, product or device.

In the related art, according to an air conditioner defrosting control method known by the inventors of the present disclosure, it is determined whether an air conditioner defrosting condition is met through the detection of a pipe temperature of the outdoor unit, and defrosting is conducted when the defrosting condition is met, during which a throttling component is fixed at a suitable opening degree for defrosting. This defrosting method can achieve better defrosting effect at certain ambient temperatures, but for different ambient temperatures, it cannot adapt to changes in the ambient temperature, and the defrosting effect varies greatly. When the ambient temperature is low or in the case of cumulative defrosting, there may be problems such as incomplete defrosting or even compressor damage due to liquid floodback during the defrosting process.

An purpose of the present disclosure is to provide an air conditioner defrosting control method, device, storage medium and air conditioner, so as to solve the problem that the above defrosting method cannot adapt to changes in ambient temperature, and the defrosting effect varies greatly under different ambient temperatures.

Figure 1:
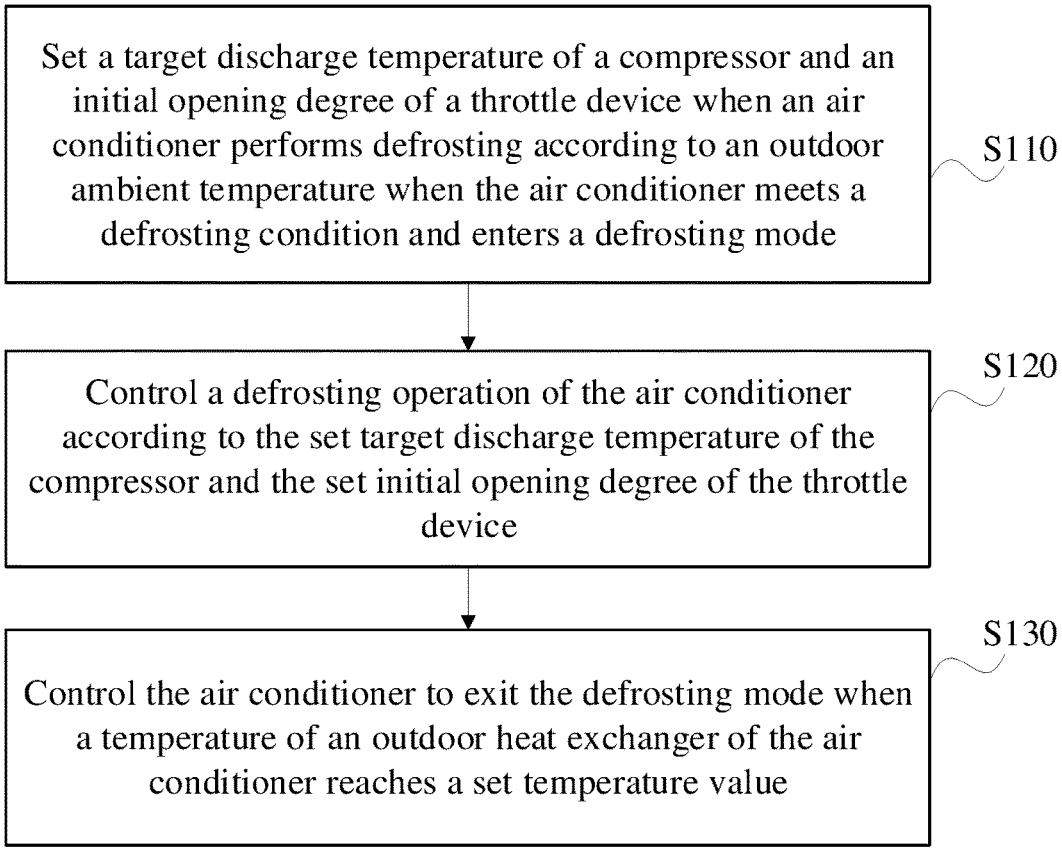
FIG. 1 is a schematic diagram showing some embodiments of an air conditioner defrosting control method provided by the present disclosure.

FIG. 1 is a schematic diagram showing some embodiments of an air conditioner defrosting control method provided by the present disclosure.

As shown in FIG. 1, according to some embodiments of the present disclosure, the air conditioner defrosting control method comprises at least step S110, step S120 and step S130.

In step S110, a target discharge temperature of a compressor and an initial opening degree of a throttle device are set when an air conditioner performs defrosting according to an outdoor ambient temperature when the air conditioner meets a defrosting condition and enters a defrosting mode.

In some embodiments, the outdoor ambient temperature corresponds to a different target discharge temperature of the compressor and a different initial opening degree of the throttle device when the outdoor ambient temperature is in a different temperature range. For example, the target discharge temperature of the compressor and the initial opening degree of the throttle device are set when the air conditioner performs defrosting according to a temperature range of at least two preset temperature ranges in which the outdoor ambient temperature is located.

Figure 2:
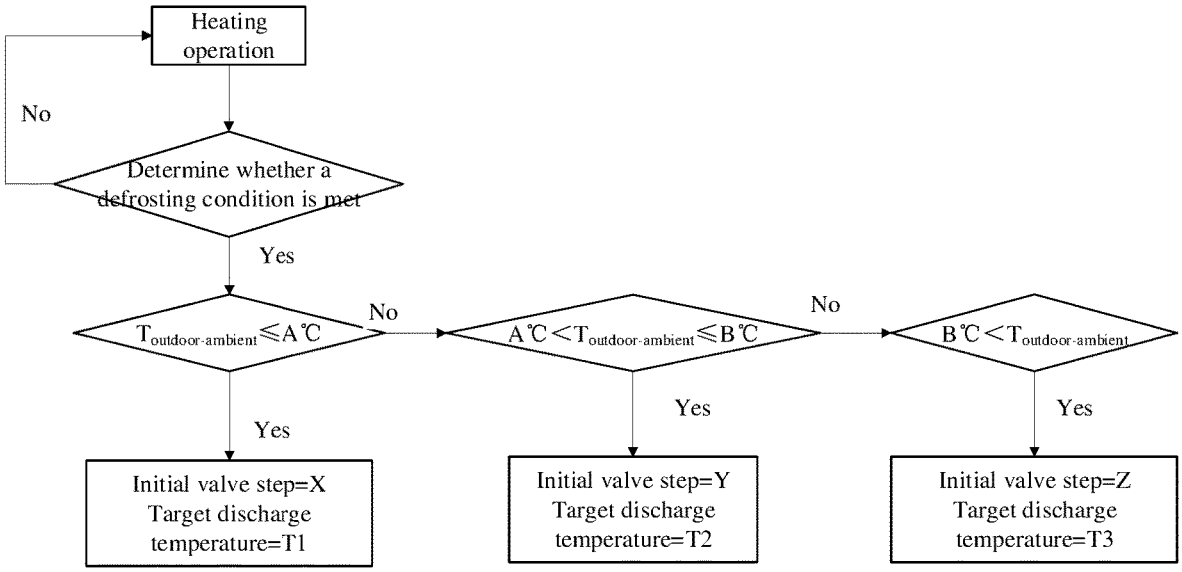
FIG. 2 is a schematic flowchart showing some embodiments of setting a target discharge temperature of a compressor and an initial opening degree of a throttle device for defrosting an air conditioner when a defrosting condition is met.

FIG. 2 is a schematic flowchart showing some embodiments of setting a target discharge temperature of a compressor and an initial opening degree of a throttle device for defrosting an air conditioner when a defrosting condition is met. As shown in FIG. 2, during the heating operation of the air conditioner, it is determined whether a defrosting condition is met. If not, the heating operation is continued. If the defrosting condition is met, a temperature range in which the outdoor ambient temperature ($T_{outdoor\text{-}ambient}$) is located is determined. For example, three continuous temperature ranges, B ° C.<$T_{outdoor\text{-}ambient}$, A ° C.<$T_{outdoor\text{-}ambient}$≤B ° C., and $T_{outdoor\text{-}ambient}$≤A ° C., are preset. For example, a value of A ranges from −20 to 0, and a value of B ranges from −10 to 10. First, it is determined whether $T_{outdoor\text{-}ambient}$≤A ° C. is satisfied. If $T_{outdoor\text{-}ambient}$≤A ° C. is satisfied, an initial valve step (the initial opening degree) of the throttle device is set to X, and the target discharge temperature is set to T1. If $T_{outdoor\text{-}ambient}$≤A ° C. is not satisfied, it is determined whether A ° C.<$T_{outdoor\text{-}ambient}$≤B ° C. is satisfied. If A ° C.<$T_{outdoor\text{-}ambient}$≤B ° C. is satisfied, the initial valve step of the throttle device is set to Y, and the target discharge temperature is set to T2. If A ° C.<$T_{outdoor\text{-}ambient}$≤B ° C. is not satisfied, it is determined whether B ° C.<$T_{outdoor\text{-}ambient}$ is satisfied. If B ° C.<$T_{outdoor\text{-}ambient}$ is satisfied, the initial valve step of the throttle device is set to Z, and the target discharge temperature is set to T3. For example, a value of X ranges from 60 to 400, and a value of T1 ranges from 35° C. to 60° C. For another example, a value of Y ranges from 80 to 450, and a value of T2 ranges from 40° C. to 70° C. For another example, a value of Z ranges from 100 to 480, and a value of T3 ranges from 40° C. to 80° C.

In step S120, a defrosting operation of the air conditioner is controlled according to the set target discharge temperature of the compressor and the set initial opening degree of the throttle device.

Figure 3:
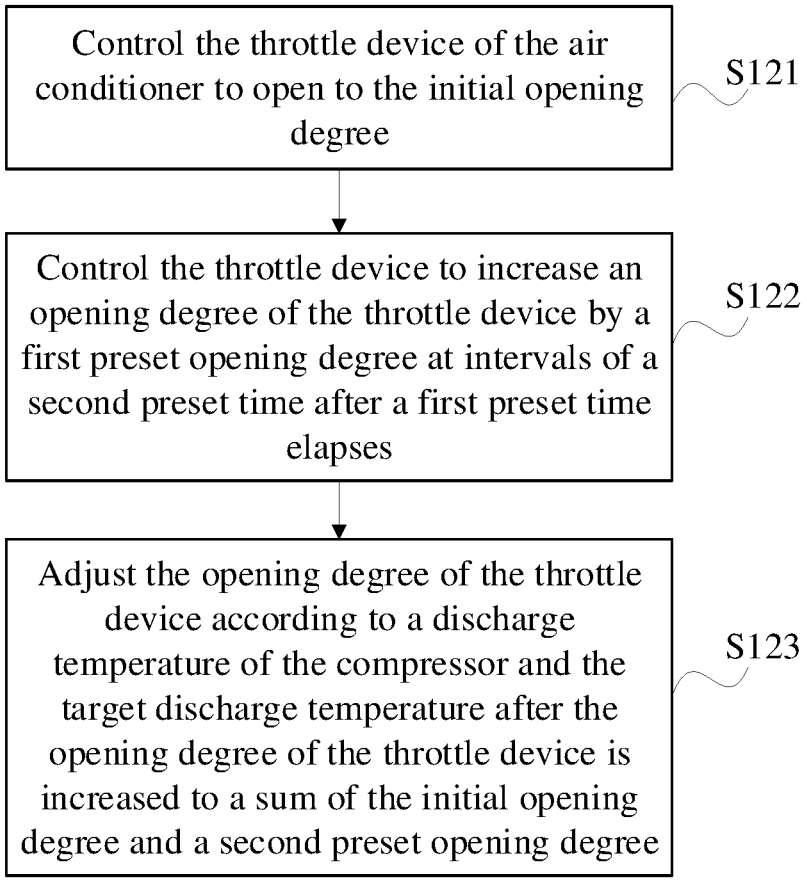
FIG. 3 is a schematic flowchart showing some embodiments of steps of controlling a defrosting operation of an air conditioner according to a set target discharge temperature of a compressor and a set initial opening degree of a throttle device.

FIG. 3 is a schematic flowchart showing some embodiments of steps of controlling a defrosting operation of an air conditioner according to a set target discharge temperature of a compressor and an set initial opening degree of a throttle device.

As shown in FIG. 3, in some embodiments, step S120 comprises steps S121, S122 and S123.

In step S121, the throttle device of the air conditioner is controlled to open to the initial opening degree.

For example, the initial opening degree (X, Y, Z) of the throttle device is set when the air conditioner performs defrosting according to a temperature range of at least two preset temperature ranges (B ° C.<$T_{outdoor\text{-}ambient}$, A ° C.<$T_{outdoor\text{-}ambient}$≤B ° C., and $T_{outdoor\text{-}ambient}$≤A ° C.) in which the outdoor ambient temperature is located. When entering the defrosting mode, after a four-way valve is reversed, an opening degree of an electronic expansion valve is controlled to open to the initial opening degree. For example, the initial opening degree is in a range from 60 to 480.

In step S122, the throttle device is controlled to increase an opening degree of the throttle device by a first preset opening degree at intervals of a second preset time after a first preset time elapses. For example, the first preset time is in a range from 10 seconds to 60 seconds. For another example, the second preset time is in a range from 20 seconds to 60 seconds. For another example, the first preset opening degree is in a range from 10 to 100.

For example, after the opening degree of the throttle device is controlled to the set initial opening degree for a first preset time, the opening degree of the throttle device is increased with the second preset time as a cycle. In each cycle, the throttle device is controlled to increase the opening degree by the first preset opening degree. For example, the throttle device is an electronic expansion valve, and the first preset opening degree is m steps. After the opening degree of the throttle device is controlled to open to the initial opening degree t seconds, the opening degree of the throttle device is increased at a rate of m steps per cycle. A maximum opening degree that can be achieved is a sum of the initial opening degree and a second preset opening degree, that is, (X, Y or Z)+M. By periodically increasing the opening degree of the throttle device, refrigerant can continuously flow into a condenser of an outdoor unit to ensure complete defrosting.

In step S123, the opening degree of the throttle device is adjusted according to a discharge temperature of the compressor and the target discharge temperature after the opening degree of the throttle device is increased to a sum of the initial opening degree and a second preset opening degree. For example, the second preset opening degree is in a range from 60 to 480.

For example, after the opening degree of the throttle device is increased to the sum of the initial opening degree and the second preset opening degree, the throttle device maintains a current opening degree when the discharge temperature of the compressor is greater than a difference between the target discharge temperature and a preset temperature and less than a sum of the target discharge temperature and the preset temperature. The throttle device is controlled to increase the opening degree of the throttle device by a third preset opening degree at intervals of a third preset time until the discharge temperature of the compressor is greater than the difference between the target discharge temperature and the preset temperature and less than the sum of the target discharge temperature and the preset temperature when the discharge temperature of the compressor is greater than the sum of the target discharge temperature and the preset temperature. For example, a maximum amount of opening degree that can be cumulatively increased is a fourth preset opening degree. The throttle device is controlled to decrease the opening degree of the throttle device by the third preset opening degree at intervals of the third preset time until the discharge temperature of the compressor is greater than the difference between the target discharge temperature and the preset temperature and less than the sum of the target discharge temperature and the preset temperature when the discharge temperature of the compressor is less than the difference between the target discharge temperature and the preset temperature. For example, a maximum amount of opening degree that can be cumulatively decreased is a fifth preset opening degree.

For example, the third preset time is in a range from 10 seconds to 60 seconds. For another example, the third preset opening degree is in a range from 10 to 100, the fourth preset opening degree is in a range from 10 to 200, and the fifth preset opening degree is in a range from 10 to 200.

The preset temperature is a correction value of a defrosting discharge temperature, which can ensure that the discharge temperature is within a reasonable range. For example, the preset temperature is in a range from 0° C. to 10° C. For example, taking $T_{outdoor\text{-}ambient} \leq A$ ° C. as an example, the target discharge temperature of the compressor is T1, the preset temperature is 5° C., the discharge temperature of the compressor is $T_{discharge}$, and the third preset opening degree is n steps, with the third preset time as a cycle, if $T1-5° C. \leq T_{discharge} \leq T1+5° C.$, the current opening degree of the throttle device is kept unchanged; if $T_{discharge} > T1+5° C.$, the opening degree is increased at a rate of n steps/cycle until $T1-5° C. \leq T_{discharge} \leq T1+5° C.$ is satisfied, wherein D steps (the fourth preset opening degree) can be increased at most; if $T_{discharge} < T1-5° C.$, the opening degree is decreased at a rate of n steps/cycle until $T1-5° C. \leq T_{discharge} \leq T1+5° C.$ is satisfied, wherein E (the fifth preset opening degree) steps can be decreased at most.

In step S130, the air conditioner is controlled to exit the defrosting mode when a temperature of an outdoor heat exchanger of the air conditioner reaches a set temperature value.

For example, if the set temperature value is T, when the pipe temperature of the outdoor unit heat exchanger reaches the set value T, the air conditioner exits the defrosting mode. For example, the set temperature value is in a range from 0° C. to 15° C.

According to the above embodiment of the present disclosure, when the air conditioner meets the defrosting condition and enters the defrosting mode, a target discharge temperature of a compressor and an initial opening degree of a throttle device for defrosting the air conditioner are set according to the outdoor ambient temperature, and the defrosting operation of the air conditioner is controlled according to the set target discharge temperature and the set initial opening degree of the throttle device, so that different defrosting controls can be adopted according to different ambient temperatures, which can achieve better defrosting effects at different ambient temperatures, reduce the problem of liquid refrigerant floodback that may occur when the ambient temperature is low or in the case of cumulative defrosting, and thereby the reliability of the system operation can be increased.

According to the above embodiments of the present disclosure, during the defrosting process of the air conditioner, a corresponding target discharge temperature of the compressor and a corresponding initial opening degree of the throttle device are set according to the outdoor ambient temperature, and the opening degree of the throttle device is adjusted according to the target discharge temperature. The defrosting effect of an air conditioner mainly depends on two factors, discharge temperature and refrigerant flow. A high discharge temperature is good for defrosting, but may cause the problem of an insufficient refrigerant flow. A low discharge temperature is not conducive to defrosting, but can make the refrigerant flow relatively large. An adjustment can be made according to the target discharge temperature to meet an optimum match between the discharge temperature and the refrigerant flow, thereby achieving the best defrosting effect.

Figure 4:
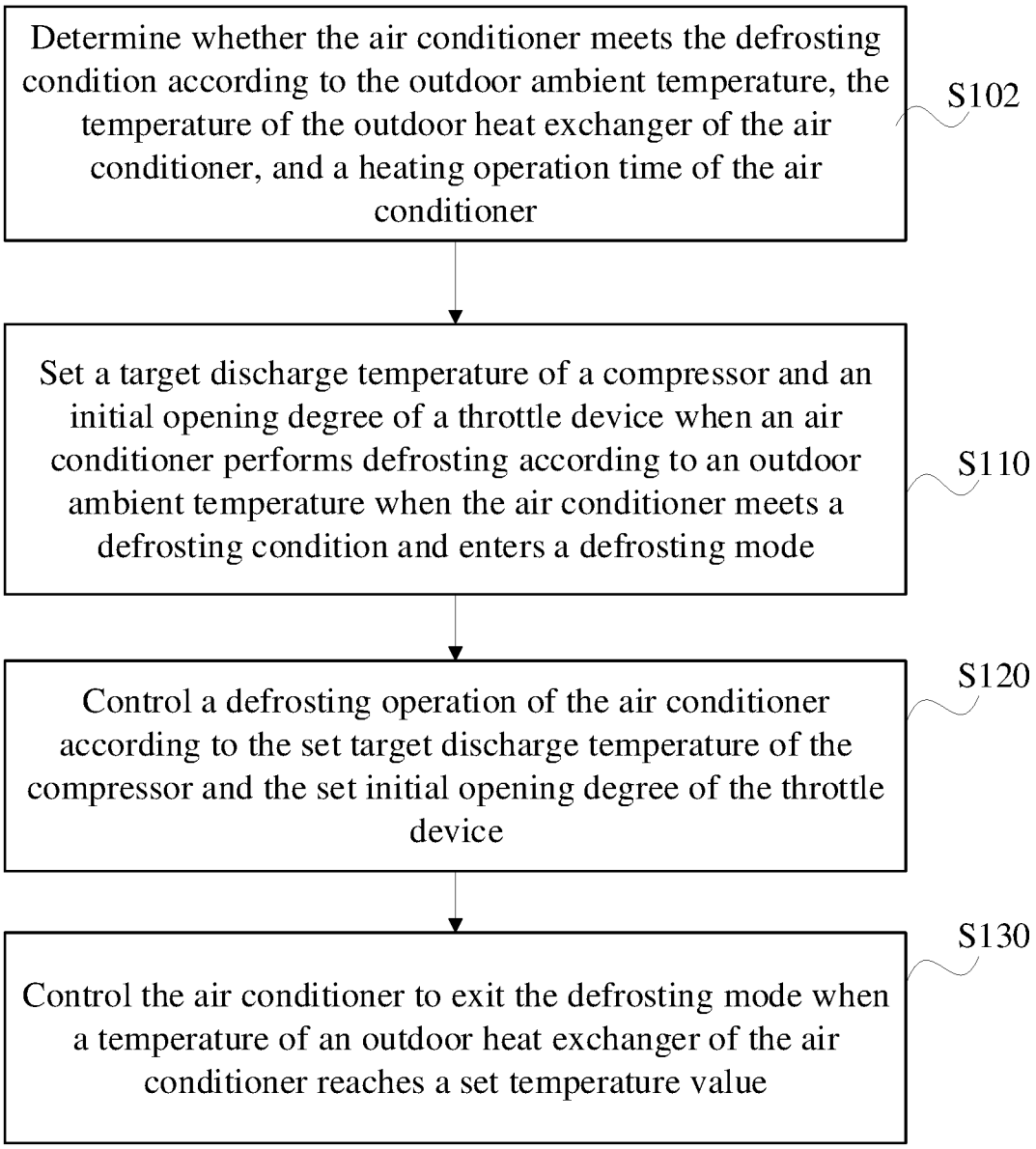
FIG. 4 is a schematic diagram showing other embodiments of an air conditioner defrosting control method provided by the present disclosure.

FIG. 4 is a schematic diagram showing other embodiments of an air conditioner defrosting control method provided by the present disclosure.

As shown in FIG. 4, based on the above embodiment, according to other embodiments of the present disclosure, the air conditioner defrosting control method further comprises step S102.

In step S102, it is determined whether the air conditioner meets the defrosting condition according to the outdoor ambient temperature, the temperature of the outdoor heat exchanger of the air conditioner, and a heating operation time of the air conditioner.

In some embodiments, the defrosting condition comprises: the temperature of the outdoor heat exchanger being less than or equal to a temperature difference between the outdoor ambient temperature and a preset temperature difference threshold (that is, a temperature difference between the outdoor ambient temperature and the temperature of the outdoor heat exchanger being greater than or equal to the preset temperature difference threshold), and the heating operation time of the air conditioner being greater than a preset operation time. That is to say, in the heating operation of the air conditioner, it is determined whether the temperature of the outdoor heat exchanger is less than or equal to the temperature difference between the outdoor ambient temperature and the preset temperature difference threshold (that is, whether the temperature difference between the outdoor ambient temperature and the temperature of the outdoor heat exchanger is greater than or equal to the preset temperature difference threshold), and whether the heating operation time of the air conditioner is greater than the preset operation time. If it is determined that the temperature of the outdoor heat exchanger is less than or equal to the temperature difference (that is, the temperature difference is greater than or equal to the preset temperature difference threshold), and the heating operation time is greater than the preset operation time, it is determined that the air conditioner meets the defrosting condition.

Herein, the outdoor ambient temperature corresponds to a different preset temperature difference threshold and a different preset operation time when the outdoor ambient temperature is in a different temperature range. That is to say, when determining whether the air conditioner meets the defrosting condition, first of all, a temperature range of at least two preset temperature ranges where the outdoor ambient temperature is located is determined, and then it is determined whether the temperature of the outdoor heat exchanger is less than or equal to a temperature difference between the outdoor ambient temperature and a preset temperature difference threshold corresponding to the temperature range where the outdoor ambient temperature is located, and whether the heating operation time is greater than a preset operation time corresponding to the temperature range where the outdoor ambient temperature is located. In some embodiments the temperature of the outdoor heat exchanger is a pipe temperature $T_{outdoor\text{-}pipe}$ of the outdoor heat exchanger.

For example, referring to table 1, three continuous temperature ranges, B ° C.$<T_{outdoor\text{-}ambient}$, A ° C.$<T_{outdoor\text{-}ambient}\leq$B ° C., and $T_{outdoor\text{-}ambient}\leq$A ° C., are preset, which correspond to three different temperature difference thresholds $T_{difference1}$, $T_{difference2}$ and $T_{difference3}$, and three different preset operation times t1, t2, and t3, respectively.

TABLE 1

| outdoor ambient temperature | outdoor pipe temperature | heating operation time |
|---|---|---|
| B ° C. < $T_{outdoor\text{-}ambient}$ | $T_{outdoor\text{-}pipe} \leq (T_{outdoor\text{-}ambient} - T_{difference1})$ | t1 |
| A ° C. < $T_{outdoor\text{-}ambient} \leq$ B ° C. | $T_{outdoor\text{-}pipe} \leq (T_{outdoor\text{-}ambient} - T_{difference2})$ | t2 |
| $T_{outdoor\text{-}ambient} \leq$ A ° C. | $T_{outdoor\text{-}pipe} \leq (T_{outdoor\text{-}ambient} - T_{difference3})$ | t3 |

For example, the preset temperature difference thresholds $T_{difference1}$, $T_{difference2}$ and $T_{difference3}$ each are in a range from 0° C. to 15° C.; the preset operation times t1, t2 and t3 each are in a range from 1 min (minute) to 5 min.

Figure 5:
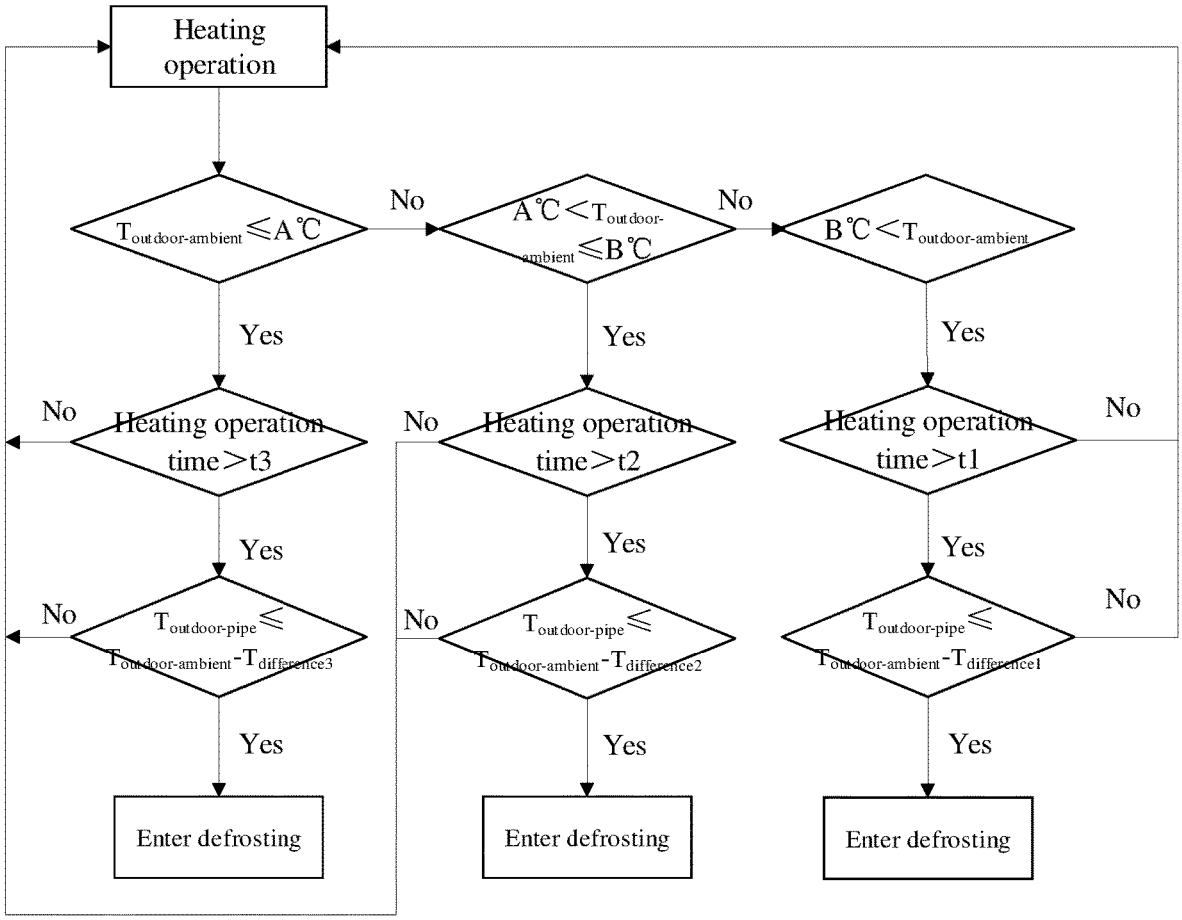
FIG. 5 is schematic flowchart showing some embodiments of determining whether an air conditioner meets a defrosting condition.

FIG. 5 is schematic flowchart showing some embodiments of determining whether an air conditioner meets a defrosting condition. As shown in FIG. 5, during the heating operation of the air conditioner, a temperature range of the three preset temperature ranges shown in Table 1 where the outdoor ambient temperature is located is determined. First, it is determined whether $T_{outdoor\text{-}ambient}\leq$A° C. is satisfied; if $T_{outdoor\text{-}ambient}\leq$A° C. is satisfied, it is determined whether the heating operation time of the air conditioner is greater than t3; and if not, the air conditioner continues the heating operation. If the heating operation time is greater than t3, it is determined whether the pipe temperature $T_{outdoor\text{-}pipe}$ the outdoor heat exchanger satisfies $T_{outdoor\text{-}pipe}\leq(T_{outdoor\text{-}ambient}-T_{difference3})$, if not, the air conditioner continues the heating operation. If $T_{outdoor\text{-}pipe}\leq(T_{outdoor\text{-}ambient}-T_{difference3})$ is satisfied, the air conditioner enters the defrosting mode. If $T_{outdoor\text{-}ambient}\leq$A ° C. is not satisfied, it is determined whether A ° C.$<T_{outdoor\text{-}ambient}\leq$B ° C. is satisfied. If A ° C.$<T_{outdoor\text{-}ambient}\leq$B ° C. is satisfied, it is determined whether the heating operation time of the air conditioner is greater than t2; and if not, the air conditioner continues the heating operation. If the heating operation time is greater than t2, it is determined whether the pipe temperature $T_{outdoor\text{-}pipe}$ of the outdoor heat exchanger satisfies $T_{outdoor\text{-}pipe}\leq(T_{outdoor\text{-}ambient}-T_{difference2})$ If not, the air conditioner continues the heating operation. If $T_{outdoor\text{-}pipe}\leq(T_{outdoor\text{-}ambient}-T_{difference2})$ is satisfied, the air conditioner enters the defrosting mode. If A ° C.$<T_{outdoor\text{-}ambient}\leq$B ° C. is not satisfied, it is determined whether B ° C.$<T_{outdoor\text{-}ambient}$ is satisfied. If B ° C.$<T_{outdoor\text{-}ambient}$ is satisfied, it is determined whether the heating operation time of the air conditioner is greater than t1. If not, the air conditioner continues the heating operation. If the heating operation time is greater than t1, it is determined whether the pipe temperature $T_{outdoor\text{-}pipe}$ of the outdoor heat exchanger satisfies $T_{outdoor\text{-}pipe}\leq(T_{outdoor\text{-}ambient}-T_{difference1})$ If not, the air conditioner continues the heating operation. If $T_{outdoor\text{-}pipe}\leq(T_{outdoor\text{-}ambient}-T_{difference1})$ is satisfied, the air conditioner enters the defrosting mode.

Figure 6:
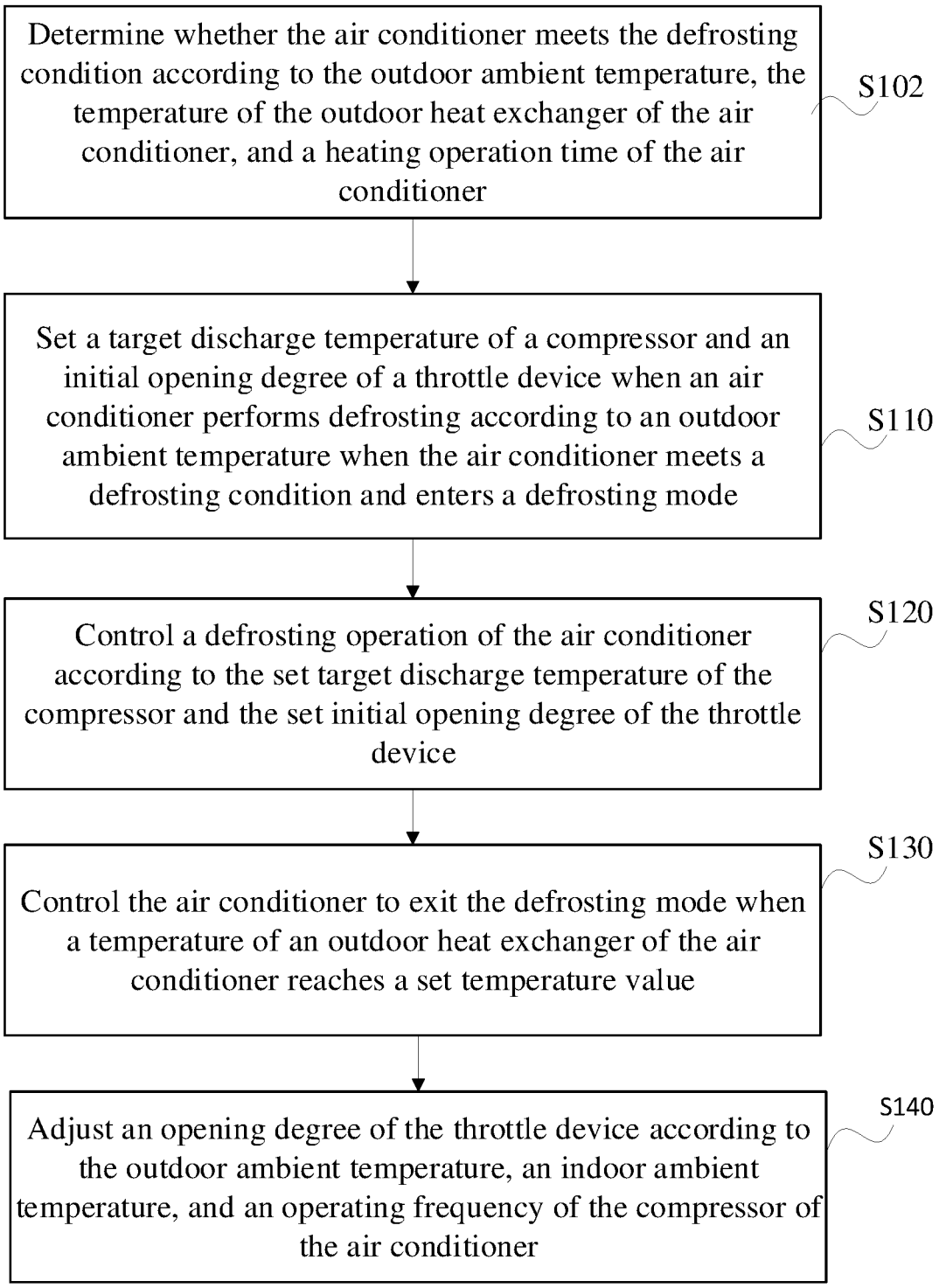
FIG. 6 is a schematic diagram showing still other embodiments of an air conditioner defrosting control method provided by the present disclosure.

FIG. 6 is a schematic diagram showing still other embodiments of an air conditioner defrosting control method provided by the present disclosure.

As shown in FIG. 6, based on any of the above embodiments, according to still other embodiments of the present disclosure, the air conditioner defrosting control method further comprises step S140.

In step S140, an opening degree of the throttle device is adjusted according to the outdoor ambient temperature, an indoor ambient temperature, and an operating frequency of the compressor of the air conditioner.

That is to say, after exiting the defrosting mode, initialization adjustment is performed for the throttle device such as an electronic expansion valve, and then the air conditioner is controlled to operate according to a normal heating operation logic. For example, the initial opening degree of the throttle device after the air conditioner exits the defrosting mode can be determined using the following formula:

$$P=a*F+b*T_{outdoor\text{-}ambient}+cT_{indoor\text{-}ambient}+d$$

wherein F is the operating frequency of the compressor, a is a correction coefficient for the operating frequency of the compressor, $T_{outdoor\text{-}ambient}$ is the outdoor ambient temperature, b is a correction coefficient for the outdoor ambient temperature, $T_{indoor\text{-}ambient}$ is the indoor ambient temperature, c is a correction coefficient for the indoor ambient temperature, and d is a correction constant. The above correction coefficient a for the operating frequency of the compressor, the correction coefficient b for the outdoor ambient temperature, the correction coefficient c for the indoor ambient temperature and the correction constant d can be obtained through an experiment.

In the above embodiments, after the air conditioner exits the defrosting mode, the opening degree of the throttle device is adjusted according to the outdoor ambient temperature, the indoor ambient temperature, and the operating frequency of the compressor of the air conditioner. The opening degree of the throttle device is corrected according to the indoor ambient temperature, the outdoor ambient temperature, and the operating frequency of the compressor to satisfy the establishment of the initial discharge temperature and avoid reliability problems such as liquid floodback.

Figure 7:
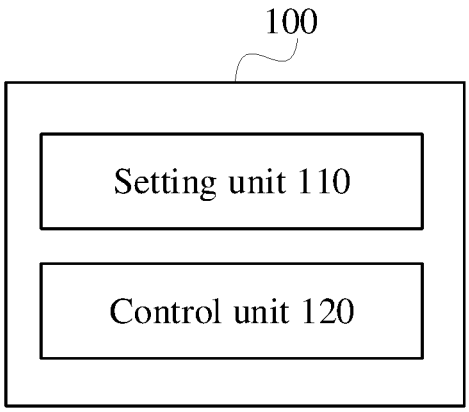
FIG. 7 is a structural block diagram showing some embodiments of an air conditioner defrosting control device provided by the present disclosure.

FIG. 7 is a structural block diagram showing some embodiments of an air conditioner defrosting control device provided by the present disclosure. As shown in FIG. 7, the air conditioner defrosting control device 100 comprises a setting unit 110 and a control unit 120.

The setting unit 110 is configured to set a target discharge temperature of a compressor and an initial opening degree of a throttle device when an air conditioner performs defrosting according to an outdoor ambient temperature when the air conditioner meets a defrosting condition and enters a defrosting mode.

In some embodiments, the outdoor ambient temperature corresponds to a different target discharge temperature of the compressor and a different initial opening degree of the throttle device when the outdoor ambient temperature is in a different temperature range. For example, the setting unit 110 set the target discharge temperature of the compressor and the initial opening degree of the throttle device when the air conditioner performs defrosting according to a temperature range of at least two preset temperature ranges in which the outdoor ambient temperature is located.

FIG. 2 is a schematic flowchart showing some embodiments of the setting unit 110 setting a target discharge temperature of a compressor and an initial opening degree of a throttle device for defrosting an air conditioner when a defrosting condition is met. As shown in FIG. 2, during the heating operation of the air conditioner, it is determined whether a defrosting condition is met. If not, the heating operation is continued. If the defrosting condition is met, a temperature range in which the outdoor ambient temperature ($T_{outdoor\text{-}ambient}$) is located is determined. For example, three continuous temperature ranges, B ° C.<$T_{outdoor\text{-}ambient}$, A ° C.<$T_{outdoor\text{-}ambient}$≤B ° C., and $T_{outdoor\text{-}ambient}$≤A ° C., are preset. First, it is determined whether $T_{outdoor\text{-}ambient}$≤A ° C. is satisfied. If $T_{outdoor\text{-}ambient}$≤A ° C. is satisfied, an initial valve step (the initial opening degree) of the throttle device is set to X, and the target discharge temperature is set to T1. If $T_{outdoor\text{-}ambient}$≤A ° C. is not satisfied, it is determined whether A ° C.<$T_{outdoor\text{-}ambient}$≤B ° C. is satisfied. If A ° C.<$T_{outdoor\text{-}ambient}$≤B ° C. is satisfied, the initial valve step of the throttle device is set to Y, and the target discharge temperature is set to T2. If A ° C.<$T_{outdoor\text{-}ambient}$≤B ° C. is not satisfied, it is determined whether B ° C.<$T_{outdoor\text{-}ambient}$ is satisfied. If B ° C.<$T_{outdoor\text{-}ambient}$ is satisfied, the initial valve step of the throttle device is set to Z, and the target discharge temperature is set to T3.

The control unit 120 is configured to control a defrosting operation of the air conditioner according to the set target discharge temperature of the compressor and the set initial opening degree of the throttle device, and control the air conditioner to exit the defrosting mode when a temperature of an outdoor heat exchanger of the air conditioner reaches a set temperature value.

In some embodiments, controlling, by the control unit 120, the defrosting operation of the air conditioner according to the set target discharge temperature of the compressor and the set initial opening degree of the throttle device comprises: controlling the throttle device of the air conditioner to open to the initial opening degree; controlling the throttle device to increase an opening degree of the throttle device by a first preset opening degree at intervals of a second preset time after a first preset time elapses; and adjusting the opening degree of the throttle device according to a discharge temperature of the compressor and the target discharge temperature after the opening degree of the throttle device is increased to a sum of the initial opening degree and a second preset opening degree.

For example, the initial opening degree (X, Y, Z) of the throttle device is set when the air conditioner performs defrosting according to a temperature range of at least two preset temperature ranges (B ° C.<$T_{outdoor\text{-}ambient}$, A ° C.≤$T_{outdoor\text{-}ambient}$ B ° C., and $T_{outdoor\text{-}ambient}$≤A ° C.) in which the outdoor ambient temperature is located. When entering the defrosting mode, after a four-way valve is reversed, the control unit 120 controls an opening degree of an electronic expansion valve to open to the initial opening degree.

After the opening degree of the throttle device is controlled to the set initial opening degree for a first preset time, the control unit 120 increases the opening degree of the throttle device with the second preset time as a cycle. In each cycle, the throttle device is controlled to increase the opening degree by the first preset opening degree. For example, the throttle device is an electronic expansion valve, and the first preset opening degree is m steps. After the opening degree of the throttle device is controlled to open to the initial opening degree t seconds, the opening degree of the throttle device is increased at a rate of m steps per cycle. A maximum opening degree that can be achieved is a sum of the initial opening degree and a second preset opening degree, that is, (X, Y or Z)+M. By periodically increasing the opening degree of the throttle device, refrigerant can continuously flow into a condenser of an outdoor unit to ensure complete defrosting.

In some embodiments, adjusting, by the control unit 120, the opening degree of the throttle device according to the discharge temperature of the compressor and the target discharge temperature comprises: controlling the throttle device to maintain a current opening degree when the discharge temperature of the compressor is greater than a difference between the target discharge temperature and a preset temperature and less than a sum of the target discharge temperature and the preset temperature; controlling the throttle device to increase the opening degree of the throttle device by a third preset opening degree at intervals of a third preset time until the discharge temperature of the compressor is greater than the difference between the target discharge temperature and the preset temperature and less than the sum of the target discharge temperature and the preset temperature when the discharge temperature of the compressor is greater than the sum of the target discharge temperature and the preset temperature; and controlling the throttle device to decrease the opening degree of the throttle device by the third preset opening degree at intervals of the third preset time until the discharge temperature of the compressor is greater than the difference between the target discharge temperature and the preset temperature and less than the sum of the target discharge temperature and the preset temperature when the discharge temperature of the compressor is less than the difference between the target discharge temperature and the preset temperature.

The preset temperature is a correction value of a defrosting discharge temperature, which can ensure that the discharge temperature is within a reasonable range. For example, taking $T_{outdoor\text{-}ambient}$≤A ° C. as an example, the target discharge temperature of the compressor is T1, the preset temperature is 5° C., the discharge temperature of the compressor is $T_{discharger}$ and the third preset opening degree is n steps, with the third preset time as a cycle, if T1−5°

C.≤$T_{discharge}$≤T1+5° C., the current opening degree of the throttle device is kept unchanged; if $T_{discharge}$>T1+5° C., the opening degree is increased at a rate of n steps/cycle until T1−5° C.≤$T_{discharge}$≤T1+5° C. is satisfied, wherein D steps (the fourth preset opening degree) can be increased at most; if $T_{discharge}$<T1−5° C., the opening degree is decreased at a rate of n steps/cycle until T1−5° C.≤$T_{discharge}$≤T1+5° C. is satisfied, wherein E (the fifth preset opening degree) steps can be decreased at most.

When the temperature of the outdoor heat exchanger of the air conditioner reaches a set temperature value, the control unit 120 controls the air conditioner to exit the defrosting mode. For example, if the set temperature is T, when the pipe temperature of the outdoor unit heat exchanger reaches the set value T, the air conditioner exits the defrosting mode.

According to the above embodiments of the present disclosure, when the air conditioner meets the defrosting condition and enters the defrosting mode, a target discharge temperature of a compressor and an initial opening degree of a throttle device for defrosting the air conditioner are set according to the outdoor ambient temperature, and the defrosting operation of the air conditioner is controlled according to the set target discharge temperature and the set initial opening degree of the throttle device, so that different defrosting controls can be adopted according to different ambient temperatures, which can achieve better defrosting effects at different ambient temperatures, reduce the problem of liquid refrigerant floodback that may occur when the ambient temperature is low or in the case of cumulative defrosting, and thereby the reliability of the system operation can be increased.

According to the above embodiments of the present disclosure, during the defrosting process of the air conditioner, a corresponding target discharge temperature of the compressor and a corresponding initial opening degree of the throttle device are set according to the outdoor ambient temperature, and the opening degree of the throttle device is adjusted according to the target discharge temperature. The defrosting effect of an air conditioner mainly depends on two factors, discharge temperature and refrigerant flow. A high discharge temperature is good for defrosting, but may cause the problem of an insufficient refrigerant flow. A low discharge temperature is not conducive to defrosting, but can make the refrigerant flow relatively large. An adjustment can be made according to the target discharge temperature to meet an optimum match between the discharge temperature and the refrigerant flow, thereby achieving the best defrosting effect.

Figure 8:
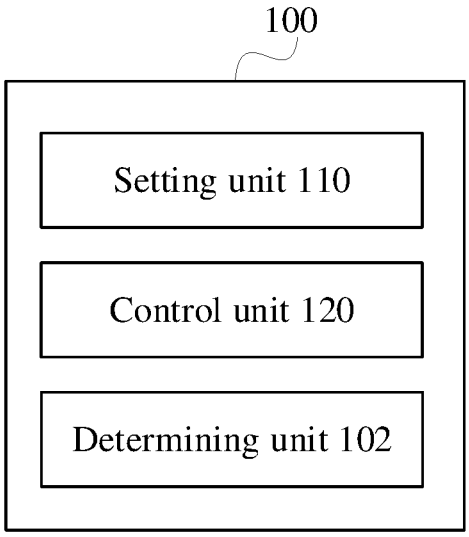
FIG. 8 is a structural block diagram showing other embodiments of an air conditioner defrosting control device provided by the present disclosure.

FIG. 8 is a structural block diagram showing other embodiments of an air conditioner defrosting control device provided by the present disclosure. As shown in FIG. 8, the air conditioner defrosting control device 100 further comprises a determining unit 102.

The determining unit 102 is configured to determine whether the air conditioner meets the defrosting condition according to the outdoor ambient temperature, the temperature of the outdoor heat exchanger of the air conditioner, and a heating operation time of the air conditioner.

In some embodiments, the defrosting condition comprises: the temperature of the outdoor heat exchanger being less than or equal to a temperature difference between the outdoor ambient temperature and a preset temperature difference threshold (that is, a temperature difference between the outdoor ambient temperature and the temperature of the outdoor heat exchanger being greater than or equal to the preset temperature difference threshold), and the heating operation time of the air conditioner being greater than a preset operation time. That is to say, in the heating operation of the air conditioner, the determining unit 102 determines whether the temperature of the outdoor heat exchanger is less than or equal to the temperature difference between the outdoor ambient temperature and the preset temperature difference threshold (that is, whether the temperature difference between the outdoor ambient temperature and the temperature of the outdoor heat exchanger is greater than or equal to the preset temperature difference threshold), and whether the heating operation time of the air conditioner is greater than the preset operation time. If it is determined that the temperature of the outdoor heat exchanger is less than or equal to the temperature difference (that is, the temperature difference is greater than or equal to the preset temperature difference threshold), and the heating operation time is greater than the preset operation time, it is determined that the air conditioner meets the defrosting condition.

Herein, the outdoor ambient temperature corresponds to a different preset temperature difference threshold and a different preset operation time when the outdoor ambient temperature is in a different temperature range. That is to say, when the determining unit 102 determines whether the air conditioner meets the defrosting condition, first of all, a temperature range of at least two preset temperature ranges where the outdoor ambient temperature is located is determined, and then it is determined whether the temperature of the outdoor heat exchanger is less than or equal to a temperature difference between the outdoor ambient temperature and a preset temperature difference threshold corresponding to the temperature range where the outdoor ambient temperature is located, and whether the heating operation time is greater than a preset operation time corresponding to the temperature range where the outdoor ambient temperature is located. In some embodiments, the temperature of the outdoor heat exchanger is a pipe temperature $T_{outdoor\text{-}pipe}$ of the outdoor heat exchanger.

For example, referring to table 1, three continuous temperature ranges, B ° C.<$T_{outdoor\text{-}ambient}$, A ° C.<$T_{outdoor\text{-}ambient}$≤B ° C., and $T_{outdoor\text{-}ambient}$≤A ° C., are preset, which correspond to three different temperature difference thresholds $T_{difference1}$, $T_{difference2}$ and $T_{difference3}$, and three different preset operation times t1, t2, and t3, respectively.

TABLE 1

| outdoor ambient temperature | outdoor pipe temperature | heating operation time |
|---|---|---|
| B ° C. < $T_{outdoor\text{-}ambient}$ | $T_{outdoor\text{-}pipe}$ ≤ ($T_{outdoor\text{-}ambient}$ − $T_{difference1}$) | t1 |
| A ° C. < $T_{outdoor\text{-}ambient}$ ≤ B ° C. | $T_{outdoor\text{-}pipe}$ ≤ ($T_{outdoor\text{-}ambient}$ − $T_{difference2}$) | t2 |
| $T_{outdoor\text{-}ambient}$ ≤ A ° C. | $T_{outdoor\text{-}pipe}$ ≤ ($T_{outdoor\text{-}ambient}$ − $T_{difference3}$) | t3 |

FIG. 5 is schematic flowchart showing some embodiments of a determining unit determining whether an air conditioner meets a defrosting condition. As shown in FIG. 5, during the heating operation of the air conditioner, a temperature range of the three preset temperature ranges shown in Table 1 where the outdoor ambient temperature is located is determined. First, it is determined whether $T_{outdoor\text{-}ambient}$≤A° C. is satisfied; if $T_{outdoor\text{-}ambient}$≤A° C. is satisfied, it is determined whether the heating operation time of the air conditioner is greater than t3; and if not, the air conditioner continues the heating operation. If the heating operation time is greater than t3, it is determined whether the pipe temperature $T_{outdoor\text{-}pipe}$ the outdoor heat exchanger satisfies $T_{outdoor\text{-}pipe} \leq (T_{outdoor\text{-}ambient} - T_{difference3})$ r if not, the air conditioner continues the heating operation. If $T_{outdoor\text{-}pipe} \leq (T_{outdoor\text{-}ambient} - T_{difference3})$ is satisfied, the air conditioner enters the defrosting mode. If $T_{outdoor\text{-}ambient} \leq$ A ° C. is not satisfied, it is determined whether A ° C.$< T_{outdoor\text{-}ambient} \leq$B ° C. is satisfied. If A ° C.$< T_{outdoor\text{-}ambient} \leq$B ° C. is satisfied, it is determined whether the heating operation time of the air conditioner is greater than t2; and if not, the air conditioner continues the heating operation. If the heating operation time is greater than t2, it is determined whether the pipe temperature $T_{outdoor\text{-}pipe}$ of the outdoor heat exchanger satisfies $T_{outdoor\text{-}pipe} \leq (T_{outdoor\text{-}ambient} - T_{difference2})$ If not, the air conditioner continues the heating operation. If $T_{outdoor\text{-}pipe} \leq (T_{outdoor\text{-}ambient} - T_{difference2})$ is satisfied, the air conditioner enters the defrosting mode. If A ° C.$< T_{outdoor\text{-}ambient} \leq$B ° C. is not satisfied, it is determined whether B ° C.$< T_{outdoor\text{-}ambient}$ is satisfied. If B ° C.$< T_{outdoor\text{-}ambient}$ is satisfied, it is determined whether the heating operation time of the air conditioner is greater than t1. If not, the air conditioner continues the heating operation. If the heating operation time is greater than t1, it is determined whether the pipe temperature $T_{outdoor\text{-}pipe}$ of the outdoor heat exchanger satisfies $T_{outdoor\text{-}pipe} \leq (T_{outdoor\text{-}ambient} - T_{difference1})$. If not, the air conditioner continues the heating operation. If $T_{outdoor\text{-}pipe} \leq (T_{outdoor\text{-}ambient} - T_{difference1})$ is satisfied, the air conditioner enters the defrosting mode.

Figure 9:
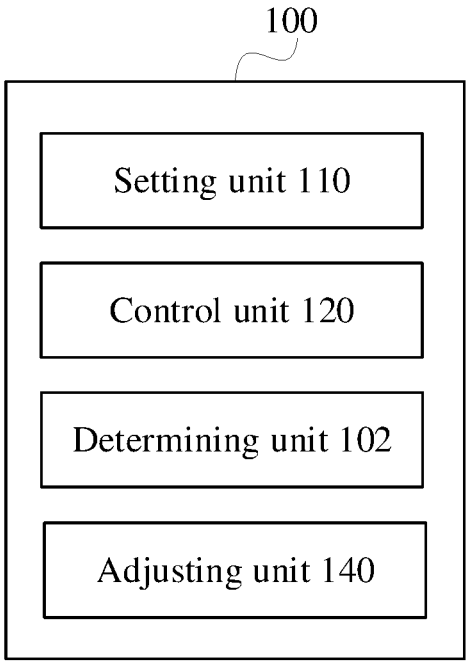
FIG. 9 is a structural block diagram showing still other embodiments of an air conditioner defrosting control device provided by the present disclosure.

FIG. 9 is a structural block diagram showing still other embodiments of an air conditioner defrosting control device provided by the present disclosure. As shown in FIG. 9, the air conditioner defrosting control device 100 further comprises an adjusting unit 140.

The adjusting unit 140 is configured to adjust an opening degree of the throttle device according to the outdoor ambient temperature, an indoor ambient temperature, and an operating frequency of the compressor of the air conditioner after the air conditioner is controlled to exit the defrosting mode.

The following formula is used to determine the initial opening degree of the throttle device after the air conditioner exits the defrosting mode:

$$P = a*F + b*T_{outdoor\text{-}ambient} + cT_{indoor\text{-}ambient} + d$$

F is the operating frequency of the compressor, a is a correction coefficient for the operating frequency of the compressor, $T_{outdoor\text{-}ambient}$ is the outdoor ambient temperature, b is a correction coefficient for the outdoor ambient temperature, $T_{indoor\text{-}ambient}$ is the indoor ambient temperature, c is a correction coefficient for the indoor ambient temperature, and d is a correction constant. The above correction coefficient a for the operating frequency of the compressor, the correction coefficient b for the outdoor ambient temperature, the correction coefficient c for the indoor ambient temperature and the correction constant d can be obtained through an experiment.

The opening degree of the throttle device is corrected according to the indoor ambient temperature, the outdoor ambient temperature, and the operating frequency of the compressor to satisfy the establishment of the initial discharge temperature and avoid reliability problems such as liquid floodback.

The present disclosure further provides a storage medium corresponding to the air conditioner defrosting control method stored thereon a computer program that when executed by a processor implements steps of any one of the aforementioned methods.

The present disclosure further provides an air conditioner corresponding to the air conditioner defrosting control method, comprising a processor, a memory, and a computer program stored in the memory and executable on the processor, wherein the processor when executing the program implements steps of any one of the aforementioned methods.

The present disclosure further provides an air conditioner corresponding to the air conditioner defrosting control device, comprising any one of the air conditioner defrosting control device described above.

Hereby, in the solution provided by the present disclosure, according to the above embodiment of the present disclosure, when the air conditioner meets the defrosting condition and enters the defrosting mode, a target discharge temperature of a compressor and an initial opening degree of a throttle device when an air conditioner performs defrosting are set according to the outdoor ambient temperature, and the defrosting operation of the air conditioner is controlled according to the set target discharge temperature and the set initial opening degree of the throttle device, so that different defrosting controls can be adopted according to different ambient temperatures, which can achieve better defrosting effects at different ambient temperatures, reduce the problem of liquid refrigerant floodback that may occur when the ambient temperature is low or in the case of cumulative defrosting, and thereby the reliability of the system operation can be increased. After the air conditioner exits the defrosting mode, the opening degree of the throttle device is adjusted according to an outdoor ambient temperature, an indoor ambient temperature, and an operating frequency of the compressor of the air conditioner. The opening degree of the throttle device is corrected according to the indoor ambient temperature, the outdoor ambient temperature, and the operating frequency of the compressor to satisfy the establishment of the initial discharge temperature and avoid reliability problems such as liquid floodback.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. In addition, various functional units may be integrated into one processing unit, or may exist separately, or two or more units may be integrated into one unit.

In the several embodiments provided by the present disclosure, it should be understood that the disclosed technical content can be implemented in other ways. The device embodiments described above are only illustrative. For example, the division of the units may be a logical function division. In actual implementation, there may be other division manners. For example, multiple units or components may be combined or may be integrated into another system, or some features can be ignored or not implemented. In addition, the displayed or discussed mutual coupling or direct coupling or communication connection may be indirect coupling or a communication connection through some interfaces, units or modules, and may be electrical or in other forms.

The units described as separate components may or may not be physically separated, and the component as the control device may or may not be a physical unit, may be located in one place, or may be distributed on multiple units. Some or all of the units may be selected according to actual needs to implement the solution of this embodiment.

If the integrated unit is implemented in the form of a software functional unit and sold or used as an independent product, it may be stored in a computer-readable storage medium. Based on this understanding, the technical solution of the present disclosure essentially or in other word, a portion thereof that contributes to the related technology or all or part of the technical solution can be embodied in the form of a software product, which is stored in a storage medium, comprising instructions to cause a computer device (which may be a personal computer, a server, or a network device, etc.) to perform all or part of the steps of the method described in the various embodiments of the present disclosure. The foregoing storage media comprise: U disks, Read-Only Memory (ROM), Random Access Memory (RAM), mobile hard disks, magnetic disks, or optical disks and other media that can store program code.

The above description is only embodiments of the present disclosure and is not intended to limit the present disclosure. For those skilled in the art, the present disclosure may have various modifications and changes. Any modifications, equivalent replacements, or improvements made within the spirit and principle of the present disclosure shall be comprised in the scope of the claims of the present disclosure.

What is claimed is:

1. An air conditioner defrosting control method, comprising:

setting a target discharge temperature of a compressor and an initial opening degree of a throttle device when an air conditioner performs defrosting according to an outdoor ambient temperature when the air conditioner meets a defrosting condition and enters a defrosting mode;

controlling a defrosting operation of the air conditioner according to the target discharge temperature of the compressor and the initial opening degree of the throttle device; and controlling the air conditioner to exit the defrosting mode when a temperature of an outdoor heat exchanger of the air conditioner reaches a set temperature value;

wherein the controlling of the defrosting operation of the air conditioner according to the target discharge temperature of the compressor and the initial opening degree of the throttle device comprises:

controlling the throttle device of the air conditioner to open to the initial opening degree;

controlling the throttle device to increase an opening degree of the throttle device by a first preset opening degree at intervals of a second preset time after a first preset time elapses; and adjusting the opening degree of the throttle device according to a discharge temperature of the compressor and the target discharge temperature after the opening degree of the throttle device is increased to a sum of the initial opening degree and a second preset opening degree.

2. The method according to claim 1, further comprising:

determining whether the air conditioner meets the defrosting condition according to the outdoor ambient temperature, the temperature of the outdoor heat exchanger of the air conditioner, and a heating operation time of the air conditioner;

wherein the defrosting condition comprises: the temperature of the outdoor heat exchanger being less than or equal to a temperature difference between the outdoor ambient temperature and a preset temperature difference threshold, and the heating operation time of the air conditioner being greater than a preset operation time;

wherein the outdoor ambient temperature corresponds to a first preset temperature difference threshold and a first preset operation time when the outdoor ambient temperature is in a first temperature range, and the outdoor ambient temperature corresponds to a second preset temperature difference threshold and a second preset operation time when the outdoor ambient temperature is in a second temperature range, wherein the first temperature range is different from the second temperature range, the first preset temperature difference threshold is different from the second preset temperature difference threshold, and the first preset operation time is different from the second preset operation time.

3. The method according to claim 1, wherein the setting of the target discharge temperature of the compressor and the initial opening degree of the throttle device when the air conditioner performs defrosting according to the outdoor ambient temperature comprises: setting the target discharge temperature of the compressor and the initial opening degree of the throttle device when the air conditioner performs defrosting according to a temperature range of at least two preset temperature ranges in which the outdoor ambient temperature is located.

4. The method according to claim 1, wherein the adjusting of the opening degree of the throttle device according to the discharge temperature of the compressor and the target discharge temperature comprises:

controlling the throttle device to maintain a current opening degree when the discharge temperature of the compressor is greater than a difference between the target discharge temperature and a preset temperature and less than a sum of the target discharge temperature and the preset temperature;

controlling the throttle device to increase the opening degree of the throttle device by a third preset opening degree at intervals of a third preset time until the discharge temperature of the compressor is greater than the difference between the target discharge temperature and the preset temperature and less than the sum of the target discharge temperature and the preset temperature when the discharge temperature of the compressor is greater than the sum of the target discharge temperature and the preset temperature; and controlling the throttle device to decrease the opening degree of the throttle device by the third preset opening degree at intervals of the third preset time until the discharge temperature of the compressor is greater than the difference between the target discharge temperature and the preset temperature and less than the sum of the target discharge temperature and the preset temperature when the discharge temperature of the compressor is less than the difference between the target discharge temperature and the preset temperature.

5. The method according to claim 1, further comprising:

adjusting an opening degree of the throttle device according to the outdoor ambient temperature, an indoor ambient temperature, and an operating frequency of the compressor of the air conditioner after the air conditioner is controlled to exit the defrosting mode;

wherein a following formula is used to determine the initial opening degree of the throttle device after the air conditioner exits the defrosting mode:

$$P=a*F+b*T_{outdoor\text{-}ambient}+c\ T_{indoor\text{-}ambient}+d,$$

wherein F is the operating frequency of the compressor, a is a correction coefficient for the operating frequency of the compressor, $T_{outdoor\text{-}ambient}$ is the outdoor ambient temperature, b is a correction coefficient for the outdoor ambient temperature, $T_{indoor\text{-}ambient}$ is the indoor ambient temperature, c is a correction coefficient for the indoor ambient temperature, and d is a correction constant.

6. An air conditioner, comprising a processor, a memory, and a computer program stored on the memory and executable on the processor, wherein the processor, when executing the program, implements an air conditioner defrosting control method, comprising:

setting a target discharge temperature of a compressor and an initial opening degree of a throttle device when an air conditioner performs defrosting according to an outdoor ambient temperature when the air conditioner meets a defrosting condition and enters a defrosting mode;

controlling a defrosting operation of the air conditioner according to the target discharge temperature of the compressor and the initial opening degree of the throttle device; and controlling the air conditioner to exit the defrosting mode when a temperature of an outdoor heat exchanger of the air conditioner reaches a set temperature value;

wherein the controlling of the defrosting operation of the air conditioner according to the target discharge temperature of the compressor and the initial opening degree of the throttle device comprises:

controlling the throttle device of the air conditioner to open to the initial opening degree;

controlling the throttle device to increase an opening degree of the throttle device by a first preset opening degree at intervals of a second preset time after a first preset time elapses; and adjusting the opening degree of the throttle device according to a discharge temperature of the compressor and the target discharge temperature after the opening degree of the throttle device is increased to a sum of the initial opening degree and a second preset opening degree.

7. The air conditioner according to claim 6, wherein the method further comprises:

determining whether the air conditioner meets the defrosting condition according to the outdoor ambient temperature, the temperature of the outdoor heat exchanger of the air conditioner, and a heating operation time of the air conditioner;

wherein the defrosting condition comprises: the temperature of the outdoor heat exchanger being less than or equal to a temperature difference between the outdoor ambient temperature and a preset temperature difference threshold, and the heating operation time of the air conditioner being greater than a preset operation time;

wherein the outdoor ambient temperature corresponds to a first preset temperature difference threshold and a first preset operation time when the outdoor ambient temperature is in a first temperature range, and the outdoor ambient temperature corresponds to a second preset temperature difference threshold and a second preset operation time when the outdoor ambient temperature is in a second temperature range, wherein the first temperature range is different from the second temperature range, the first preset temperature difference threshold is different from the second preset temperature difference threshold, and the first preset operation time is different from the second preset operation time.

8. The air conditioner according to claim 6, wherein the setting of the target discharge temperature of the compressor and the initial opening degree of the throttle device when the air conditioner performs defrosting according to the outdoor ambient temperature comprises: setting the target discharge temperature of the compressor and the initial opening degree of the throttle device when the air conditioner performs defrosting according to a temperature range of at least two preset temperature ranges in which the outdoor ambient temperature is located.

9. The air conditioner according to claim 6, wherein the adjusting of the opening degree of the throttle device according to the discharge temperature of the compressor and the target discharge temperature comprises:

controlling the throttle device to maintain a current opening degree when the discharge temperature of the compressor is greater than a difference between the target discharge temperature and a preset temperature and less than a sum of the target discharge temperature and the preset temperature;

controlling the throttle device to increase the opening degree of the throttle device by a third preset opening degree at intervals of a third preset time until the discharge temperature of the compressor is greater than the difference between the target discharge temperature and the preset temperature and less than the sum of the target discharge temperature and the preset temperature when the discharge temperature of the compressor is greater than the sum of the target discharge temperature and the preset temperature; and controlling the throttle device to decrease the opening degree of the throttle device by the third preset opening degree at intervals of the third preset time until the discharge temperature of the compressor is greater than the difference between the target discharge temperature and the preset temperature and less than the sum of the target discharge temperature and the preset temperature when the discharge temperature of the compressor is less than the difference between the target discharge temperature and the preset temperature.

10. The air conditioner according to claim 6, wherein the method further comprises:

adjusting an opening degree of the throttle device according to the outdoor ambient temperature, an indoor ambient temperature, and an operating frequency of the compressor of the air conditioner after the air conditioner is controlled to exit the defrosting mode;

wherein a following formula is used to determine the initial opening degree of the throttle device after the air conditioner exits the defrosting mode:

$$P=a*F+b*T_{outdoor\text{-}ambient}+cT_{indoor\text{-}ambient}+d,$$

wherein F is the operating frequency of the compressor, a is a correction coefficient for the operating frequency of the compressor, $T_{outdoor\text{-}ambient}$ is the outdoor ambient temperature, b is a correction coefficient for the outdoor ambient temperature, $T_{indoor\text{-}ambient}$ is the indoor ambient temperature, c is a correction coefficient for the indoor ambient temperature, and d is a correction constant.

11. A non-transitory storage medium on which a computer is stored, which when executed by a processor implements an air conditioner defrosting control method, comprising:

setting a target discharge temperature of a compressor and an initial opening degree of a throttle device when an air conditioner performs defrosting according to an outdoor ambient temperature when the air conditioner meets a defrosting condition and enters a defrosting mode;

controlling a defrosting operation of the air conditioner according to the target discharge temperature of the compressor and the initial opening degree of the throttle device; and controlling the air conditioner to exit the defrosting mode when a temperature of an outdoor heat exchanger of the air conditioner reaches a set temperature value;

wherein the controlling of the defrosting operation of the air conditioner according to the target discharge temperature of the compressor and the initial opening degree of the throttle device comprises:

controlling the throttle device of the air conditioner to open to the initial opening degree;

controlling the throttle device to increase an opening degree of the throttle device by a first preset opening degree at intervals of a second preset time after a first preset time elapses; and adjusting the opening degree of the throttle device according to a discharge temperature of the compressor and the target discharge temperature after the opening degree of the throttle device is increased to a sum of the initial opening degree and a second preset opening degree.

12. The non-transitory storage medium according to claim 11, wherein the method further comprises:

determining whether the air conditioner meets the defrosting condition according to the outdoor ambient temperature, the temperature of the outdoor heat exchanger of the air conditioner, and a heating operation time of the air conditioner;

wherein the defrosting condition comprises: the temperature of the outdoor heat exchanger being less than or equal to a temperature difference between the outdoor ambient temperature and a preset temperature difference threshold, and the heating operation time of the air conditioner being greater than a preset operation time;

wherein the outdoor ambient temperature corresponds to a first preset temperature difference threshold and a first preset operation time when the outdoor ambient temperature is in a first temperature range, and the outdoor ambient temperature corresponds to a second preset temperature difference threshold and a second preset operation time when the outdoor ambient temperature is in a second temperature range, wherein the first temperature range is different from the second temperature range, the first preset temperature difference threshold is different from the second preset temperature difference threshold, and the first preset operation time is different from the second preset operation time.

13. The non-transitory storage medium according to claim 11, wherein the setting of the target discharge temperature of the compressor and the initial opening degree of the throttle device when the air conditioner performs defrosting according to the outdoor ambient temperature comprises: setting the target discharge temperature of the compressor and the initial opening degree of the throttle device when the air conditioner performs defrosting according to a temperature range of at least two preset temperature ranges in which the outdoor ambient temperature is located.

14. The non-transitory storage medium according to claim 11, wherein the adjusting of the opening degree of the throttle device according to the discharge temperature of the compressor and the target discharge temperature comprises:

controlling the throttle device to maintain a current opening degree when the discharge temperature of the compressor is greater than a difference between the target discharge temperature and a preset temperature and less than a sum of the target discharge temperature and the preset temperature;

controlling the throttle device to increase the opening degree of the throttle device by a third preset opening degree at intervals of a third preset time until the discharge temperature of the compressor is greater than the difference between the target discharge temperature and the preset temperature and less than the sum of the target discharge temperature and the preset temperature when the discharge temperature of the compressor is greater than the sum of the target discharge temperature and the preset temperature; and controlling the throttle device to decrease the opening degree of the throttle device by the third preset opening degree at intervals of the third preset time until the discharge temperature of the compressor is greater than the difference between the target discharge temperature and the preset temperature and less than the sum of the target discharge temperature and the preset temperature when the discharge temperature of the compressor is less than the difference between the target discharge temperature and the preset temperature.

15. The non-transitory storage medium according to claim 11, wherein the method further comprises:

adjusting an opening degree of the throttle device according to the outdoor ambient temperature, an indoor ambient temperature, and an operating frequency of the compressor of the air conditioner after the air conditioner is controlled to exit the defrosting mode;

wherein a following formula is used to determine the initial opening degree of the throttle device after the air conditioner exits the defrosting mode:

$$P=a*F+b*T_{outdoor\text{-}ambient}+cT_{indoor\text{-}ambient}+d,$$

wherein F is the operating frequency of the compressor, a is a correction coefficient for the operating frequency of the compressor, $T_{outdoor\text{-}ambient}$ is the outdoor ambient temperature, b is a correction coefficient for the outdoor ambient temperature, $T_{indoor\text{-}ambient}$ is the indoor ambient temperature, c is a correction coefficient for the indoor ambient temperature, and d is a correction constant.

* * * * *